US006122778A

United States Patent [19]

Cohen

[11] Patent Number: 6,122,778

[45] Date of Patent: Sep. 26, 2000

[54] LIFT VEST

[76] Inventor: Cynthia Price Cohen, 35 W. 83rd St., New York, N.Y. 10024

[21] Appl. No.: 09/271,743

[22] Filed: Mar. 18, 1999

[51] Int. Cl.[7] ..... A61H 3/00; A41D 1/04

[52] U.S. Cl. ..... 5/81.1 R; 5/89.1; 182/3; 2/102; 297/484

[58] Field of Search ..... 128/845, 874, 128/875; 2/102; 5/81.1 R, 81.1 T, 89.1, 83.1; 297/5, 465, 484; 182/3

[56] References Cited

U.S. PATENT DOCUMENTS

| | | | |
|---|---|---|---|
| 1,035,642 | 8/1912 | Rosse . | |
| 4,226,474 | 10/1980 | Rupert et al. | 297/484 |
| 4,450,991 | 5/1984 | Gougeon | 224/159 |
| 4,863,409 | 9/1989 | Johnson et al. | 441/80 |
| 4,922,860 | 5/1990 | Hutchings | 119/96 |
| 5,080,191 | 1/1992 | Sanchez | 297/484 X |
| 5,101,768 | 4/1992 | Cates | 119/96 |
| 5,289,896 | 3/1994 | Giglio | 182/3 |
| 5,297,834 | 3/1994 | Vanarnem | 294/140 |
| 5,397,171 | 3/1995 | Leach | 297/484 |
| 5,514,019 | 5/1996 | Smith | 441/88 |
| 5,619,751 | 4/1997 | Ray et al. | 2/102 |
| 5,647,378 | 7/1997 | Farnum | 5/81.1 T |
| 5,733,014 | 3/1998 | Murray | 297/465 X |
| 5,738,046 | 4/1998 | Williams | 182/3 |
| 5,890,227 | 4/1999 | Brown | 2/102 |

FOREIGN PATENT DOCUMENTS

| | | | |
|---|---|---|---|
| 1506926 | 4/1976 | United Kingdom | 5/89.1 |

*Primary Examiner*—Michael Trettel
*Attorney, Agent, or Firm*—Head, Johnson & Kachigian

[57] ABSTRACT

A lift vest to enable a caregiver to assist a patient in moving from one position to another includes a base garment having an exterior surface that is shaped to cover at least a substantial portion of the upper torso of a patient, a horizontal waist belt supported to the exterior surface of the garment and dimensioned to surround the torso of the patient, a horizontal chest belt supported to the exterior surface of the garment and dimensioned to surround the upper torso of the patient, a left shoulder strap supported on the exterior surface of the garluent and configured to extend over the left shoulder of the patient is secured at opposed end portions to the horizontal waist and chest belts and a right shoulder strap is supported on the exterior surface of the garment and is configured to extend over the right shotulder of the patient and is secured at opposed end portions to the horizontal waist and chest belts, the belts and straps providing hand holds for use by the caregiver when assisting the patient.

17 Claims, 6 Drawing Sheets

FIG. 6
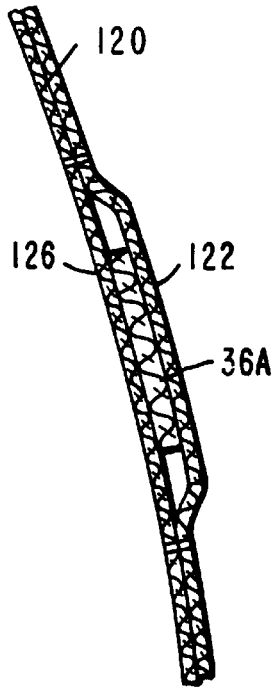
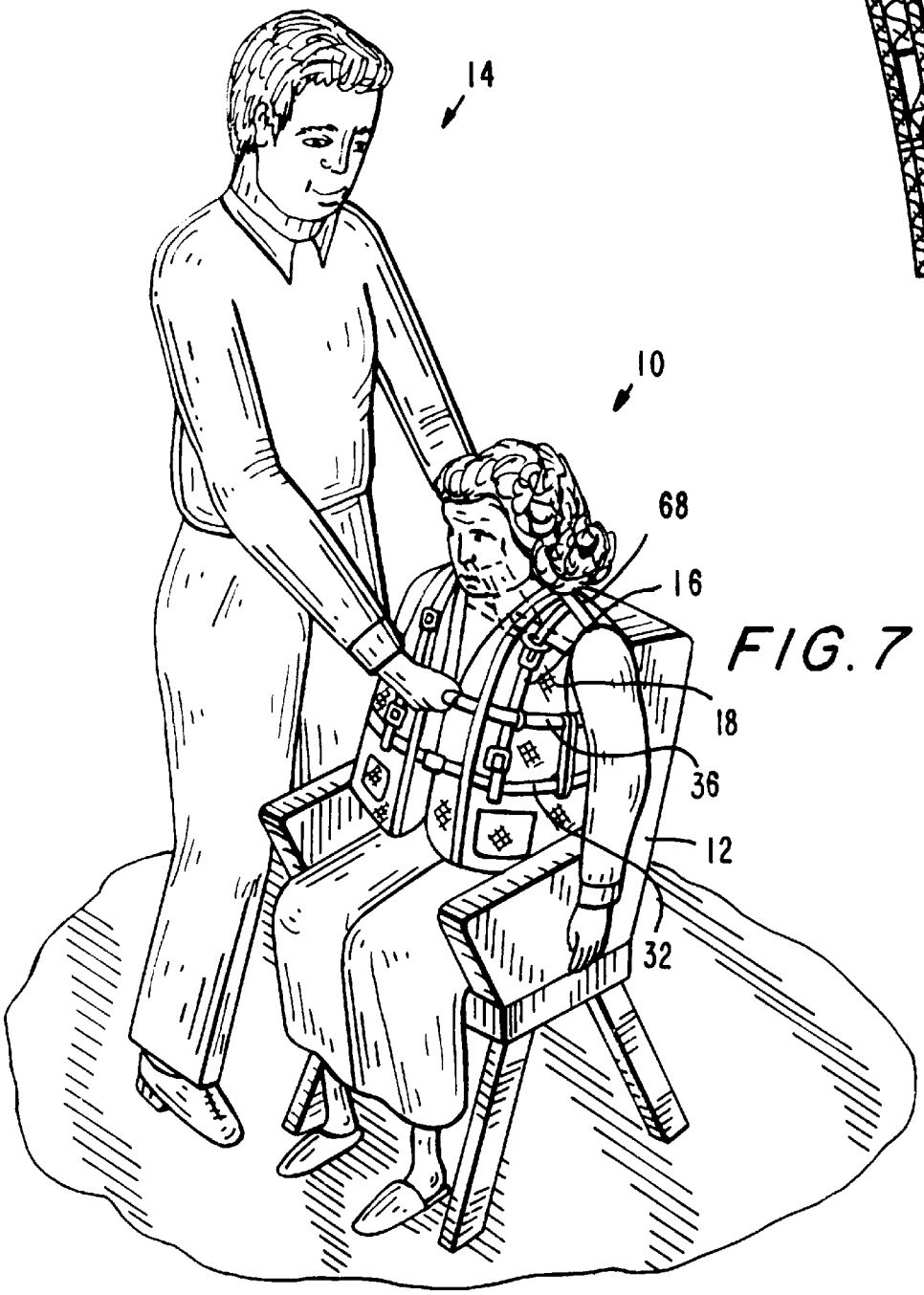
FIG. 7

LIFT VEST

CROSS REFERENCES

This application is not related to any pending United States or foreign patent applications or to any microfiche appendix.

BACKGROUND OF THE INVENTION

1. Field of the Invention

This invention provides a garment-type device designed to enable a caretaker to safely assist a patient to move from one position to another. By "patient" is meant any person irrespective of age, sex, health condition, physical impairment or disability that requires, even if only occasionally, assistance in moving. As an example, the device of this invention is a garment that facilitates moving a patient from a wheelchair to another type of seating arrangement, such as an adjacent seat, bathroom stool, automobile, dentist or beautician's chair. Further, the device is particularly useful in assisting a patient in getting out of and rising from a bed or in turning a bed patient from one position to another or assisting a patient who may be unstable when standing or walking.

Many elderly or handicapped persons, and particularly persons confined to wheelchairs, are unable to stand on their own and require the assistance of one or more persons to move them from a wheelchair or other seating arrangement or to a standing position. Grasping a patient to assist him or her in moving from one position to another is difficult. Some health professionals or family caregivers grasp patients by their arms or their belts to assist in hoisting them from a wheelchair or other seated position. Others grab articles of clothing such as a trouser seat or shirt collar, however, these garments are not designed or adapted for easy grasping, and sometimes tear, and require a strong grip on the part of the caregiver. This is not only uncomfortable for the patient, it can also cause bruising or more serious injuries.

Further, because of the difficulty of taking hold of a patient that needs to be moved from one position to another, a caregiver frequently sustains injuries to himself or herself such as an injured back. Injuries to caregivers are particularly likely when it is necessary to quickly move to try to assist a patient that is falling.

2. Prior Art

For background information relating to devices to be worn by a person to enable another to take hold of him or her, reference may be had to the following previously issued United States patents:

| U.S. PAT. NO. | INVENTOR | TITLE |
|---|---|---|
| 1,035,642 | Rosse | Invalid Carrier |
| 4,450,991 | Gougeon | Fabric Made Chair for Facilitating Transportation of a Disabled Person |
| 4,863,409 | Johnson et al. | Method and Apparatus for Aid in Lifesaving Operations on Water |
| 4,922,860 | Hutchings | Child or Disabled Person Training Harness |
| 5,101,768 | Cates | Torso Harness |
| 5,297,834 | Vanarnem | Method for Lifting and Transferring a Disabled Person To and From a Wheelchair |

-continued

| U.S. PAT. NO. | INVENTOR | TITLE |
|---|---|---|
| 5,514,019 | Smith | Life Jacket with Stabilizing Handles |
| 5,619,751 | Ray et al. | Safety Vest and Method for Use in Water and Other Applications |

SUMMARY OF THE INVENTION

The invention is a device that may be a piece of apparel or a harness, that provides a plurality of hand holds to enable a caregiver assisting a patient wearing the piece of apparel in moving the patient from one position to another. When in the form of an apparel the device may be like a vest or a poncho.

In one embodiment the invention includes a basic vest type garment having on its outer surface a horizontal belt that extends around the mid-section of the torso (the waist) of the patient, below the lower portion of the rib cage. Above and spaced from it is a horizontal chest belt that extends around the torso of the patient below the arms and around the upper rib cage of the patient. Extending over the right and left shouldel of the garment are right and left shoulder straps. These straps are secured to the horizontal waist and chest belts. An upper back strap is also affixed to the right and left shoulder straps. The upper back strap is horizontal and above the horizontal chest belt, that is, between the chest belt and the neckline of the garment. Under the arm, between the front and back portions of the shoulder straps, there is a double belt control that connects the chest and waist belts by means of a belt loop mechanism. The purpose of the double belt control is to provide an even distribution of stress between the various belts and straps.

The horizontal waist and chest belts, the right and left shoulder straps, the horizontal upper back strap and the double belt controls form a superstructure that is loosely secured to the exterior of the garment. The belts and straps provide numerous positions that can be grasped by a caregiver in assisting a patient in moving from one position to another. The interrelationship of the belts and straps to the garment help more evenly transfer force from the belts and straps to the patient. The garment having the belts and straps thereon is expeditiously positioned onto or removed from a patient.

In one embodiment the use of an underlying garment can be eliminated and a harness is thereby provided formed of horizontal waist and chest belts, vertical left and right shoulder straps, a horizontal upper back strap, and the double belt controls, all secured to each other and each having buckles or other attachment means by which the harness may be positioned onto a patient and adjustments made for the size and shape of the patient.

A better and mole complete understanding of the invention will be obtained from the following description of the preferred embodiments and the claims, taken in conjunction with the attached drawings.

BRIEF DESCRIPTION OF THE DRAWINGS

FIG. 6 is a fragmentary cross-sectional view taken along the line 6—6 of FIG. 5 showing how decorative trim 120 on the vest of FIG. 5 provides loops for receiving horizontal straps.

FIG. 7 is another isometric view showing a caregiver preparing to assist a seated patient to an upstanding position and showing an alternate manner of using the lift vest compared to the manner illustrated in FIG. 1.

DETAILED DESCRIPTION OF THE PREFERRED EMBODIMENTS

Figure 2:
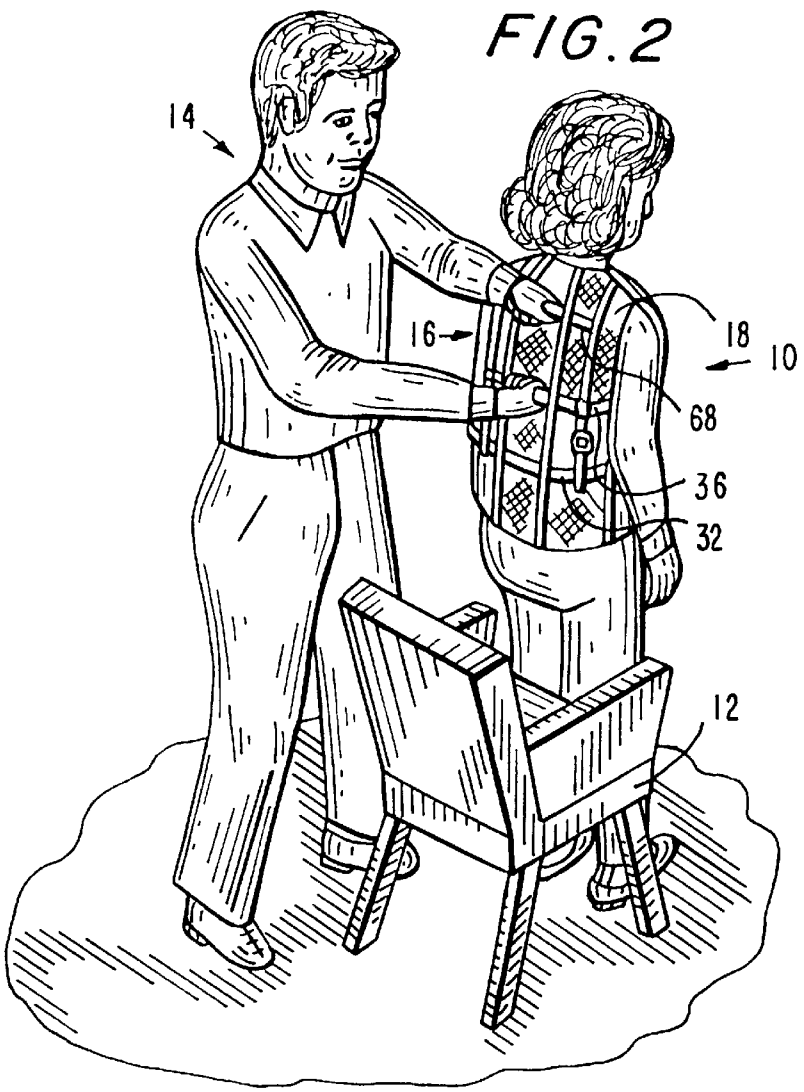
FIG. 2 is an isometric view that is a continuation of FIG. 1 and shows the patient having been assisted to a standing position with the caregiver continuing to hold onto the lift vest as would be required to ensure that the patient is stable.
Figure 1:
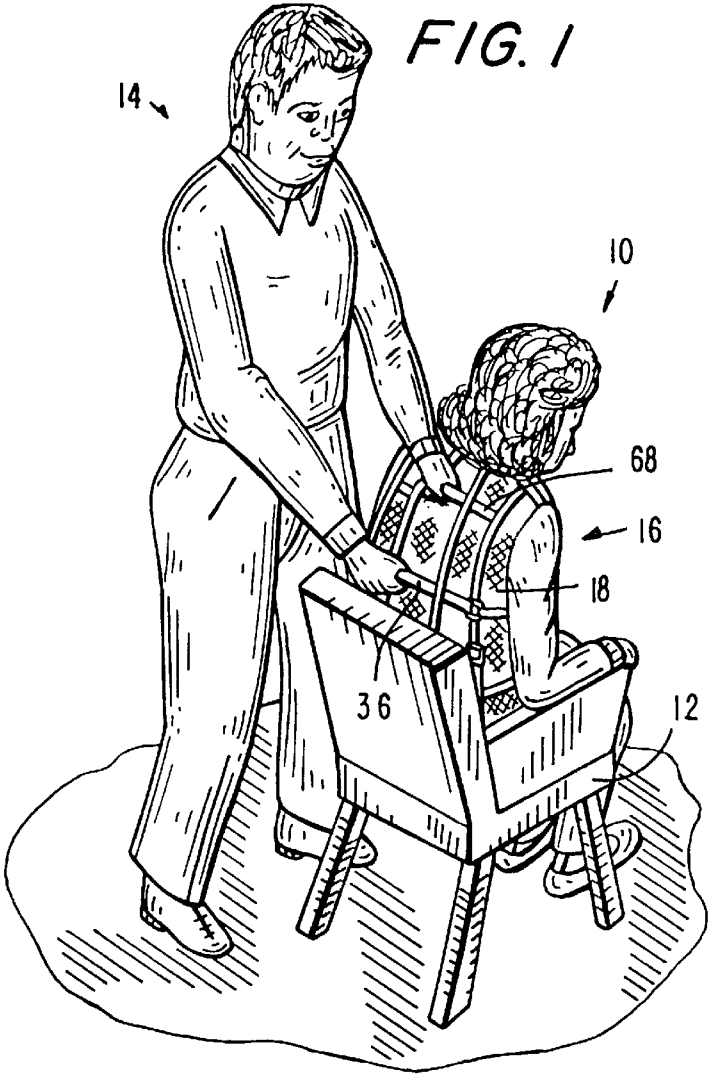
FIG. 1 is an isometric view of a patient seated in a chair with a caretaker standing beside the patient. The patient is shown wearing a lift vest of the type that is subject of this invention and the caregiver is shown grasping the lift vest to illustrate one manner of using the lift vest to assist the patient from a seated to a standing position.

FIGS. 1, 2 and 7 illustrate the application of this invention. In these figures, a patient is indicated generally by the numeral 10. By "patient" is meant any person that requires assistance in moving from one position to another. Patients that can make use of the invention herein include handicapped, elderly and disabled individuals. While in FIGS. 1, 2 and 7 the illustrated change in positions is from a seated to an upright position this is by way of example only. The lift vest of this invention can equally as well be employed in transferrinig a person from a wheelchair to a bathroom stool; from a wheelchair to a bed or vice versa, into and out of a bathtub; into or out of an automobile or other type of conveyance and for moving from one position to another in a bed or stabilize a patient who is walking. In FIGS. 1 and 7 the patient 10 is seated in a chair 12 and a caregiver 14 is shown standing by the patient preparatory to helping the patient to rise from a seated to an upright position as shown in FIG. 2. Patient 10 is shown with a lift vest generally indicated by the numeral 16, that is the subject of this invention. The function of lift vest 16 is to provide hand holds or places for caregiver 14 to grasp to assist patient 10. A serious problem normally encountered in assisting a patient is that it is very difficult to grasp or hold onto a human body. The loss of an effective grasp can frequently result in a patient being injured.

Figure 3:
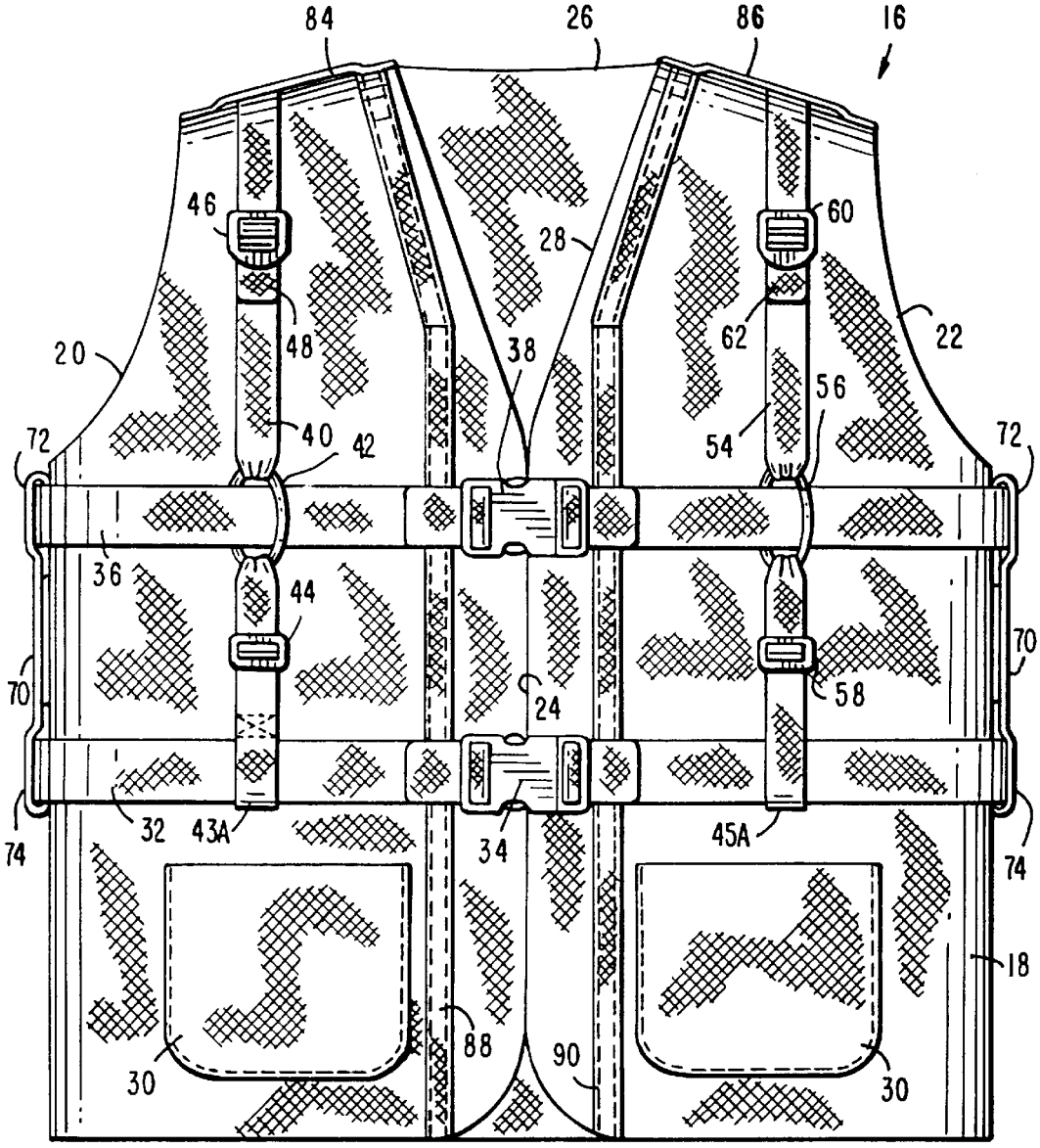
FIG. 3 is an elevational front view of a lift vest of this invention in which the lift vest is of the "vest" type, that is open down the front. The lift vest of FIG. 3 is worn by a patient and put on in the same way that a shirt or jacket is put on with the front open and after the lift vest is on the patient, the front is closed.
Figure 4:
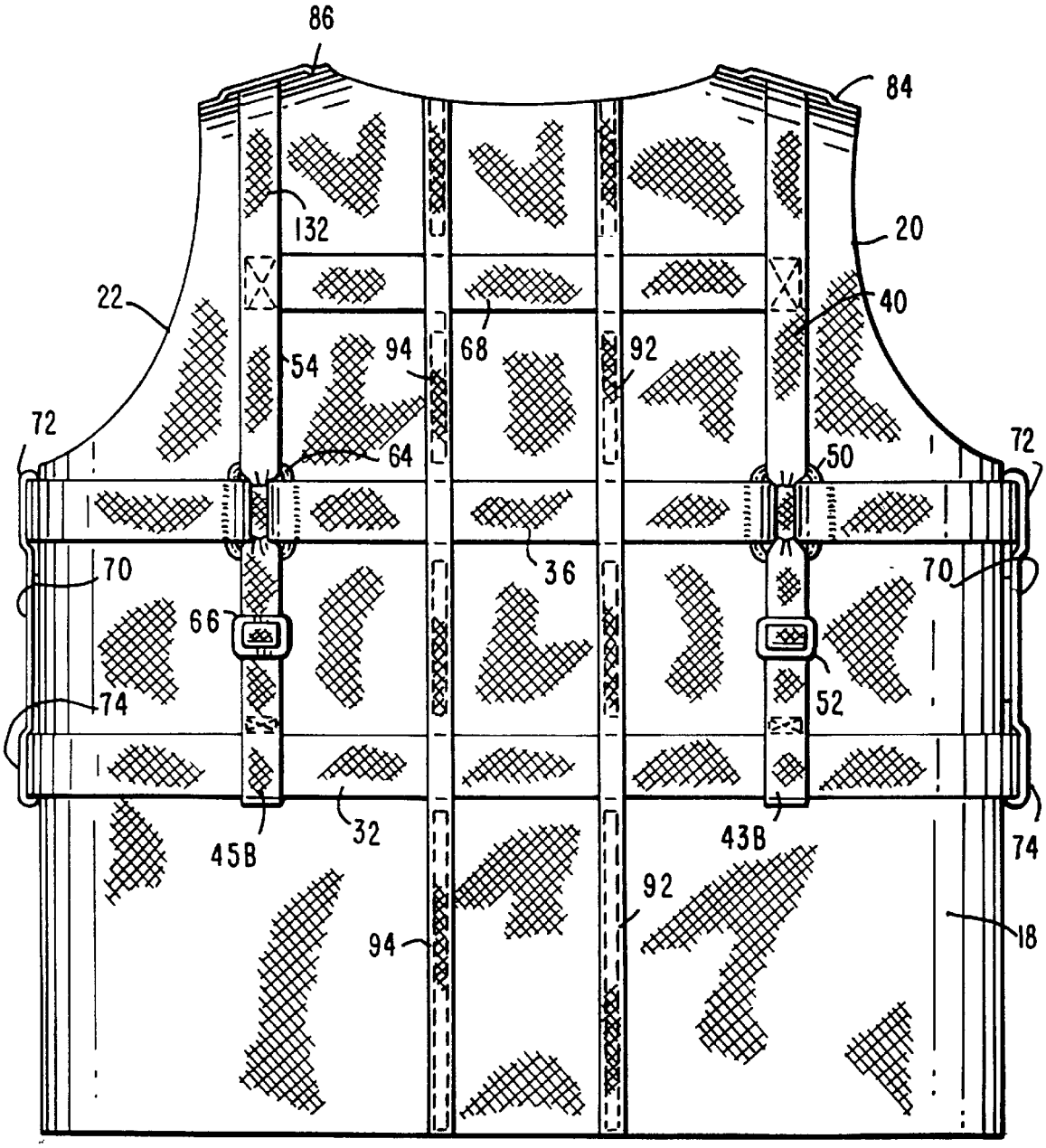
FIG. 4 is an elevational back view of the lift vest of FIG. 3.

The lift vest 16, as shown on the patient in FIGS. 1, 2 and 7, is illustrated in detail in FIGS. 3, 4. 5 and 6 to which reference will now be had. The lift vest can be configured into several basic types, including as examples in a "vest" type, a "poncho" type, a "jacket" type and a "harness" type. A vest type will be first described by reference to FIGS. 3 and 4. As shown in FIGS. 3 and 4 the lift vest is shaped as basic fabric garment 18 and configured to fit the upper torso of a patient. The garment 18 has a right sleeve hole 20 and a left sleeve hole 22. The vest type garment of FIGS. 3 and 4 has an open front 24 in the same way that a typical shirt or vest closes down the front. The garment 18 is configured to provide a neck opening 26 that, in FIG. 3, by example, is V-shaped at 28. Further, the garment 18 is optionally provided with pockets 30. Thus, the basic vest type garment 18 is very similar in all respects to a sleeveless open front shirt or vest.

The garment 18 is transformed into a lift vest by providing a reinforcing skeletal structure surrounding and forming a part of the vest that provides numerous hand hold places that enable a caregiver to assist the vest wearer. A first and an important structure of the vest is a waist belt 32 that is preferably made of webbing that goes around the waist of the patient. Waist belt 32 functions to close the front opening 24 and is provided with a buckle 34. Buckle 34 is by example, adjustable on both sides (a double adjustable buckle) so that the length of waist belt 32 can easily be adjusted to snugly but comfortably fit around the waist of the patient.

A chest belt 36 that can be formed of webbing is closed in front by a similar double adjustable buckle 38 so that the length of the chest belt 36 can be adjusted to snugly but comfortably fit around the upper torso portion of the patient. Waist belt 32 and chest belt 36 are horizontal and parallel to each other when the patient is in a seated or standing position as shown in FIGS. 1, 2 and 7.

Extending over the right shoulder of the garment as seen in FIG. 3 is a right shoulder strap 40. In the illustrated arrangement of FIG. 3 the right shoulder strap 40 includes, as part of a length thereof, a ring 42 that can be made of metal or plastic, the ring serving to slidably receive chest belt 36. The lower end of the right shoulder strap 40 forms a loop 43A that receives waist belt 32. Positioned between loop 43A of shoulder strap 40 and ring 42 is a slider 44 that is made of metal or plastic in the form essentially of a square with a cross bar across the middle. One end of the lower portion of right shoulder strap 40 is attached to the cross bar while the other end of the webbing passes through ring 42 and then back through slider 44 and down into the belt loop 43A. The purpose of slider 44 is to allow the lower portion of the right shoulder strap 40 to be adjusted so as to fit the individual wearing the garment.

The upper portion of right shoulder strap 40, that is the portion above ring 42, includes a strap lock 46 which can also be known as a "ladder lock" or a "single tab lock". The strap lock 46 is a type of buckle which allows for easy adjustment and release. It is typically made of three components, that is a plastic strap lock having one end of the webbing forming the right shoulder strap affixed to it with another end of the right shoulder strap extending through the strap lock and over a cross member in the strap lock. The forward end portion 48 of the right shoulder strap extends through the strap lock to permit adjustability of the length of the right shoulder strap to thereby fit the patient.

FIG. 4 illustrates the right shoulder strap 40 as seen from the rearward view of the garment. FIG. 4 shows that chest belt 36 includes two rings 50 and 64 and that right shoulder strap 40 is affixed to ring 50 and left shoulder strap 54 is affixed to ring 64. The lower end of the right shoulder strap, as seen in the back view of FIG. 4, has a belt loop 43B around waist belt 32. Positioned between the waist belt 32 and chest belt 36 is a slider 52 permitting adjustment of the length of the lower rearward side of the right shoulder strap. The slider 52 functions in the same way as has been described for the slider 44 employed in the front portion of the right shoulder strap.

A left shoulder strap 54 is in all respects identical to the right shoulder strap 40 and includes, as seen in FIG. 3, a ring 56; a slider 58 corresponding to the slider 44 of the right shoulder strap: a strap lock 60 functioning the same as described for strap lock 46 of the right shoulder strap: a shoulder strap portion 62 that functions as described for the right shoulder strap portion 48; and as seen in FIG. 4, a ring 64 functioning like ring 50 as previously described and a slider 66 that has the same function as slider 52 employed on the right shoulder strap. Left shoulder strap 54 has at the lower front end a belt loop 45A that receives waist belt 32 and at the lower back end a belt loop 45B through which waist belt 32 passes.

These basic elements, that is waist belt 32, chest belt 36, right shoulder strap 40 and left shoulder strap 54 provide the superstructure for lifting a patient. An additional important element of the lifting superstructure is an upper back strap 68 as seen in FIG. 4. This strap, which is preferably made of webbing, is attached horizontally to the opposed right and left shoulder straps 40 and 54 and is positioned so that it will ride just above the shoulder blades of the patient, thus providing a place to hold when lifting a person from a wheelchair or similar seating.

Secured to each side of the lift vest is a double belt control 70 (see FIGS. 3 and 4) which is essentially a double belt loop. It is made up of a strap of webbing which has been doubled and stitched on both ends to create upper loop 72 that receives chest belt 36 and a lower loop 74 that receives waist belt 32. A double belt control 70 is placed under each of the arm holes 20 and 22 of the garment so that the waist belt 32 and chest belt 36 are threaded through the loops. The function of double belt controls 70 is to equalize lifting force between the two belts 32 and 36.

As shown in FIGS. 3 and 4, there is provided over each shoulder area of the vest a shoulder epaulet, the epaulet over the right shoulder being indicated by numeral 84 and over the left shoulder by 86. The epaulets are secured at their opposite ends to garment 18 but form loops that receive right shoulder strap 40 and left shoulder strap 54 respectively.

Decorative trims 88 and 90 employed on the front of the vest as illustrated in FIG. 3 create a series of loops which act as guides for the horizontal waist and chest belts which pass underneath the trims. In the back of the vest, as illustrated in FIG. 4, decorative trims 92 and 94 extend over the outside of waist belt 32, chest belt 36 and upper back strap 68 and provides loops for receiving each of these items. Thus, in addition to a decorative purpose, the trims serve a functional purpose to more securely anchor the basic structural elements 32. 36 and 68 to garment 18. Decorative trim can be used at other places on the garment either for aesthetic purposes only or for a combination of aesthetic and functional purposes.

Figure 5:
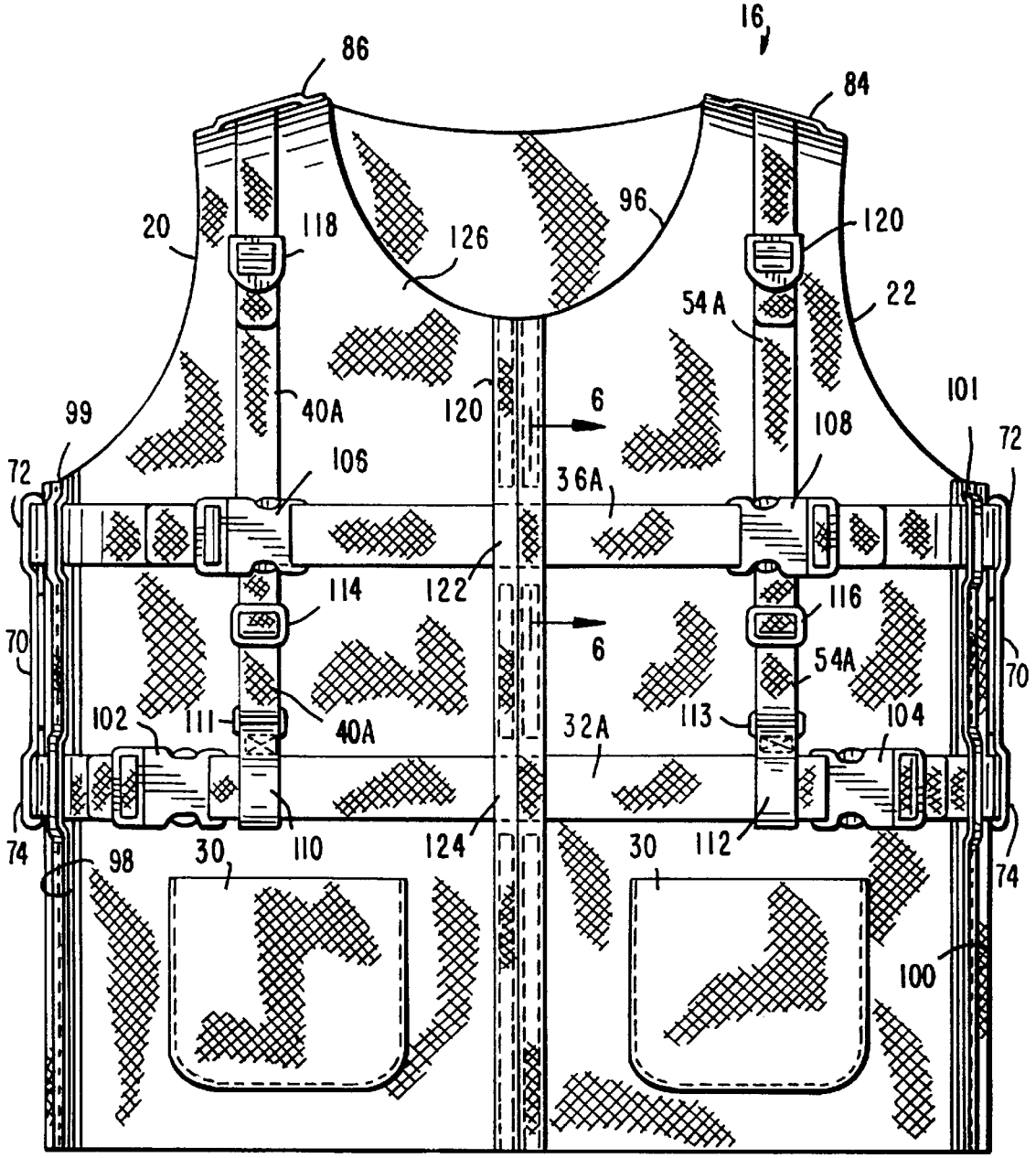
FIG. 5 is a front elevational view of an alternate embodiment of the invention in which the vest is of a "poncho" type. In the embodiment of FIG. 5 the lift vest does not open down the middle, as in FIG. 3, but opens on each side so that the lift vest can be placed on the user by extending it over the head of the user and thereafter closing the opposed sides. The embodiment of FIG. 5 does not require a patient to be able to extend his or her arms through arm openings as is required in the embodiment of FIG. 3. The reverse side of the poncho type lift vest of FIG. 5 can have an appearance substantially the same as illustrated in FIG. 4.

Turning now to FIG. 5 the embodiment of the invention wherein the garment is of a "poncho" style is illustrated, that is the front view of the poncho style of the vest is illustrated.

In this embodiment the vest is placed on the patient by positioning it over the patient's head with an integral front and back portion connected at the shoulders. The lift vest of FIG. 5 has a rounded neck opening 96 and is open at the opposed sides 98 and 100. The vest is designed to provide a right sleeve opening 20 and a left sleeve opening 22 as in the embodiment of FIGS. 3 and 4.

The poncho type lift vest of FIG. 5 includes the same essential features of that of FIG. 3 including a waist belt 32 (32A) and a chest belt 36 (36A); a right shoulder strap 40A and a left shoulder strap 54A. In the poncho style the waist belt 32 (32A) is provided with two spaced apart single adjustable buckles 102 and 104. Each of buckles 102 and 104 is permanently attached to a front portion of waist belt 32 (32A) and is releasably attached to a back portion of the belt 32 (32A). Buckles 102 and 104 provide for adjusting the length of waist belt 32 (32A).

In like manner, front chest belt 36A in the poncho style has buckles 106 and 108 that are single adjustable buckles so that the length of chest belt 36 can be adjusted to fit the patient.

On the poncho type vest the front portion of chest belt 36A and the front portion of waist belt 32A are stationary in length and therefore not adjustable however the overall lengths of the waist and chest belts are adjustable by way of buckles 102, 104, 106 and 108.

To install the poncho type lift vest of FIG. 5 buckles 102, 104, 106 and 108 are released allowing the two portions of the vest to be spread fully apart to permit the vest to be lowered down over the head of the patient with the patient's head extending through neck opening 96. Thereafter the opposed ends of the waist and chest belts are buckled and the lengths are adjusted if necessary so that the garment fits comfortably but snugly around the patient.

The lower ends of right shoulder strap 40A and left shoulder strap 54A are provided with belt loops 110 and 112 respectively which are attached to solid loop mechanisms 111 and 113 that can be made of plastic or metal, securing them to the front portion of waist belt 32A. A slider 114 is placed on right shoulder strap 40A and in like manner slider 116 on the left shoulder strap 54A. The sliders allow the webbing harness to be adjusted so that the total length is compatible with the patient.

Each of the shoulder straps also includes a strap lock 118 and 120 respectively that have the same purpose as strap locks 46 and 60 on the left and right shoulder straps of the vest type lift vest as seen in FIG. 3. Strap locks 118 and 120 permit adjustment of the length of shoulder straps 40A and 54A.

The poncho type lift vest of FIG. 5 has a decorative strip 120 down the center which appears to be two pieces but can be one piece since in the poncho type lift vest the front does not open. The decorative strip 120 is sewn to the front portion of the garment except in areas that receive waist belt 32A and chest belt 36A, that is, the decorative strip provides loops 122 and 124 to receive the horizontal belts. This is seen in FIGS. 5 and 6 wherein the front portion 126 of the garment that has the decorative strip 120 attached to it provides a loop 122 that receives chest belt 36A and a loop 124 that receives waist belt 32A. Similar loops are provided by decorative trims 88 and 90 in FIG. 3; 92 and 94 in Figure 4 and 99 and 101 in FIG. 5. Cross-sectional view FIG. 6 illustrates chest belt 36A passing underneath loop 122 in decorative trim 120 that is affixed to the garment front portion 126.

The rearward view of the poncho type lift vest has substantially the appearance as seen in FIG. 4, it being understood that the particular use of the rings 50 and 64 to interconnect the chest belt and shoulder straps is optional and this feature can vary without departing from the basic concept of the invention.

The invention has been described wherein the lift vest includes a garment which supports a horizontal waist belt, a horizontal chest belt, an upper back strap and opposed vertical left and right shoulder straps each of which provides opportunity for a caregiver to grasp to assist a patient. Double belt controls interlink the waist and chest belts. The garment helps transfer force from the belts and straps to the patient however it is understood that the basic concepts of the invention can be practiced in an embodiment in which a garment is not employed and a lift vest harness is made up of a horizontal waist belt, a horizontal chest belt, opposed left and right shoulder straps, an upper back strap and double belt controls, all interconnected with each other and that can be assembled on a patient and adjusted to the patient. A harness may be of the type that is employed with a vest type embodiment as in FIG. 3 or a poncho type embodiment as in FIG. 5 as either provides the same end result of affording readily available hand holds for a caregiver to assist a patient.

In FIGS. 1 and 2 the lift vest 16 may be either of the vest or the poncho type since the rearward appearance is substantially the same. FIG. 7 shows the patient 10 with a lift vest 16 that is of the open front or vest type as shown in FIG. 3.

The lift vest system as illustrated and described herein provides for substantially improved convenience and safety when a caregiver must assist a patient moving from one position to another in a way to substantially reduce the strain on the caregiver and on the patient while reducing the possibility of the caregiver losing his or her grip on the patient.

Figure 8:
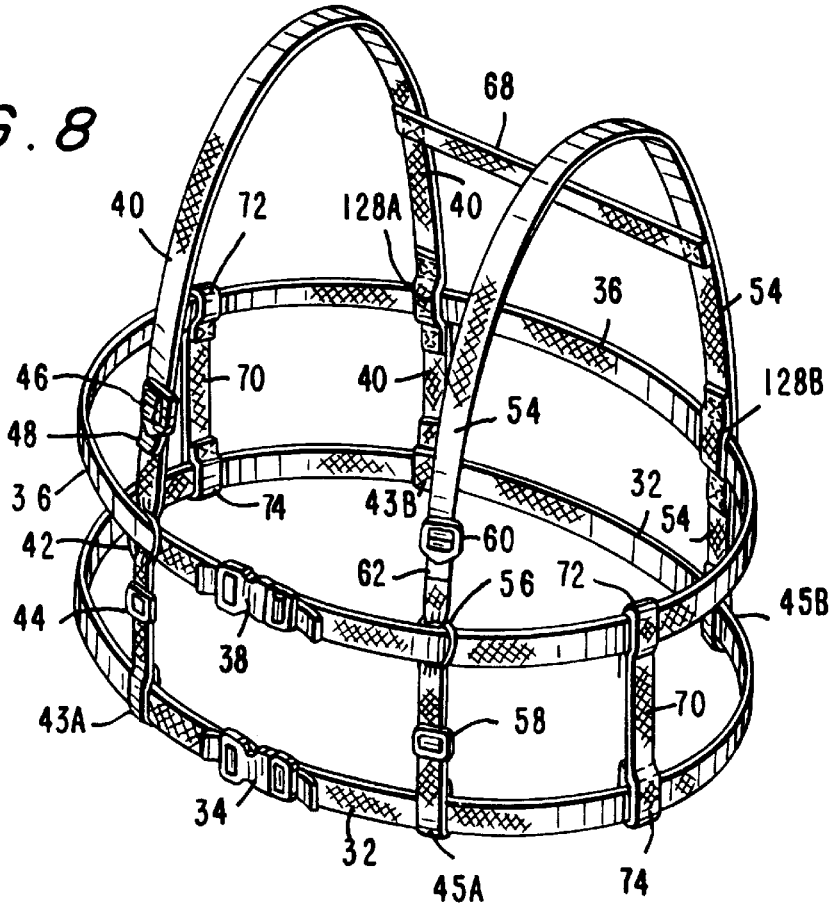
FIG. 8 is an isometric view of a harness that embodies the invention without direct association with a garment.

FIG. 8 illustrates an embodiment of the invention in which the lift vest is in the form of a harness, as contrasted with the invention as illustrated in FIGS. 3 through 5 in which the invention includes a garment. The harness of FIG. 8 is completely independent of any associated garment. The harness of FIG. 8 includes essentially all of the same components as have previously been described with reference to FIGS. 3, 4 and 5, except it does not include any underlying garment, the only other significant difference being that the left and right shoulder straps 40 and 54 do not have, in the back portions thereof, rings such as rings 50 and 64 as shown in FIG. 4 but instead, have short length straps 128A and 128B that provide a passageway for chest belt 36. It should be understood that this is an option only as the harness embodiment of FIG. 8 could employ rings at 50 and 64 as described with reference to FIG. 4.

The harness of FIG. 8 is adapted to fit over a variety of upper body garments, such as shirts, blouses sweaters, or so forth, or even over a patient having no undergarment. The embodiment of the invention illustrated in FIG. 8 can very quickly be placed on a patient in an emergency when it is necessary to move or to assist in movement of a patient when time might not otherwise permit installing a lift vest that incorporated a garment.

Figure 9:
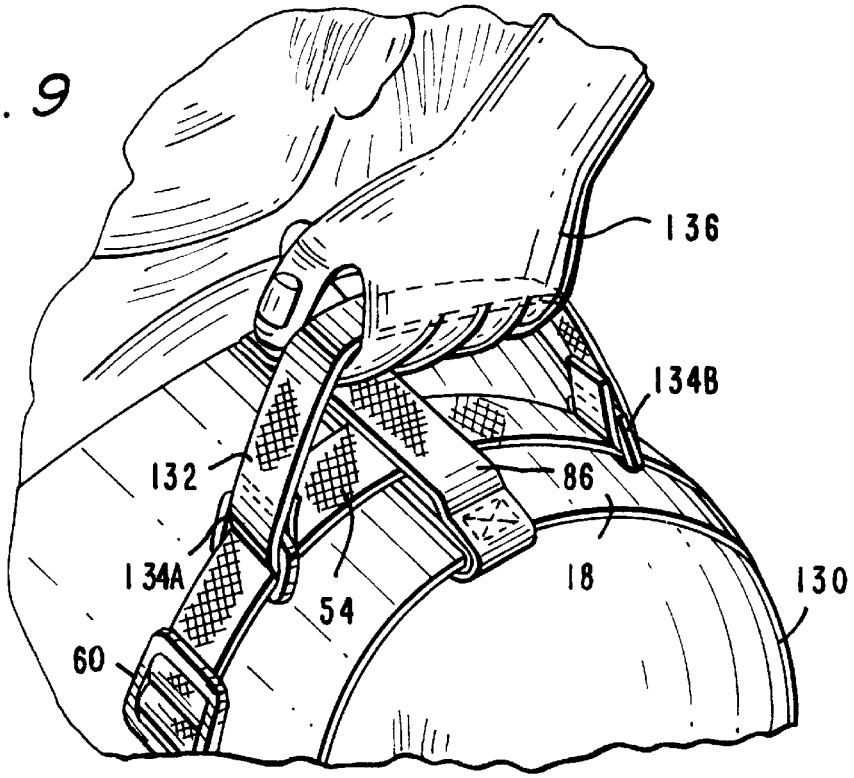
FIG. 9 is an isometric view of the left shoulder portion of a patient showing a left shoulder lift that loops above the left shoulder strap. A similar right shoulder lift would be employed to provide hand holds for caregivers.

FIG. 9 illustrates an embodiment of the invention that adds additional hand holds. FIG. 9 shows the left shoulder 130 of a patient wearing a lift vest 18. The left shoulder strap 54, strap lock 60 and left epaulet 86 all have been previously described. In addition to these elements, a shotulder lift strap 132 is added. Affixed to opposed ends of shoulder lift strap 132 are solid loops 134A and 134B that receives left shoulder strap 54. The use of solid loops 134A and 134B is optional as the opposed ends of lift shoulder strap 132 could be secured directly to left shoulder strap 54.

Left shoulder lift strap 132 is provided with slack, as illustrated, so that a caregiver, can insert his or her hand 136 under the shoulder lift strap to assist in lifting, moving or guiding a patient.

Obviously, a mating right shoulder lift would be applied to the right shoulder strap of the lift vest or lift harness.

FIGS. 3 and 4 illustrate the lift vest without sleeves, it being understood that garment 18 could have sleeves if desired. The lift vest could be part of a jacket to be worn outdoors in cool or rainy weather.

Whereas, the present invention has been described in relation to the drawings attached hereto, it should be understood that other and further modifications, apart from those shown or suggested herein, may be made within the spirit and scope of this invention, such as the attachment and sewing of the harness directly to the garment and the addition of sleeves to the garment to create a jacket.

Further Velcro® (hook and loop) and other similar closures can be used instead of buckles.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

What is claimed is:

1. A lift vest configured to be worn on the upper torso of a patient that provides hand holds by which a caregiver may assist the patient in moving from one position to another or in standing or walking, comprising:

a base garment having an exterior surface and shaped to cover at least a substantial portion of the upper torso of a user;

a horizontal belt supported to and surrounding said exterior surface of said garment;

a left shoulder strap supported on said exterior surface of said garment and configured to extend over a left shoulder portion of a patient and being secured at opposed end portions to said horizontal belt;

a right shoulder strap supported on said exterior surface of said garment and configured to extend over a right shoulder portion of a patient and being secured at opposed end portions to said horizontal belt;

a left shoulder lift strap secured at opposite end portions to said left shoulder strap; and a right shoulder lift strap secured at opposite end portions to said right shoulder strap portions.

2. A lift vest according to claim 1 wherein said horizontal belt is adjustable in length.

3. A lift vest according to claim 1 wherein said horizontal belt has opposed end portions that are attachable to and detachable from each other.

4. A lift vest according to claim 1 wherein said horizontal belt and straps are supported to said exterior surface of said base garment by loops affixed to said garment wherein said left and right shoulder straps are adjustable.

5. A lift vest according to claim 1 wherein said left and right shoulder straps are adjustable.

6. A lift vest according to claim 1 including:

a second horizontal belt supported on said exterior surface of said garment and configured to surround the upper torso of a user, the second horizontal belt being elevationally positioned above said first mentioned horizontal belt, said left shoulder and right shoulder straps being secured to both said first mentioned and said second horizontal belts.

7. A lift vest according to claim 6 including a plurality of spaced apart double belt control straps interlinking said first mentioned horizontal belt and said second horizontal belt.

8. A lift vest according to claim 1 wherein said garment has a front and a back portion that overlies a front and a back portion of the upper torso of a user, comprising:

a horizontal back strap positioned above said horizontal belt and overlying said garment back portion and being affixed at opposed end portions to said left shoulder strap and said right shoulder strap.

9. A lift vest configured to be worn on the upper torso of a patient that provides hand holds by which a caregiver may assist the patient in moving from one position to another or in standing or walking, comprising:

a base garment having an exterior surface and shaped to cover at least a substantial portion of the upper torso of a user;

a first horizontal belt supported to and surrounding said exterior surface of said garment;

a second horizontal belt supported on said exterior surface of said garment and configured to surround the upper torso of a user, the second horizontal belt being elevationally positioned above said first horizontal belt, a left shoulder strap supported on said exterior surface of said garment and configured to extend over a left shoulder portion of a patient and being secured at opposed end portions to said horizontal belt;

a right shoulder strap supported on said exterior surface of said garment and configured to extend over a right shoulder portion of a patient and being secured at opposed end portions to said horizontal belt, said straps providing hand holds for use by a caregiver;

said left shoulder and right shoulder straps being secured to both said first mentioned and said second horizontal belts; and a plurality of spaced apart double belt control straps interlinking said first horizontal belt and said second horizontal belt.

10. A lift harness adapted to fit on the upper torso of a patient and to be used by a caregiver to assist the patient in moving from one position to another or in standing or walking, comprising:

a horizontal waist belt that encircles a waist area of a patient;

a horizontal chest belt that encircles a chest area of a patient above said waist belt;

a left shoulder strap affixed at opposite end portions to said waist belt and attached to said chest belt and extending over a left shoulder portion of a patient;

a right shoulder strap affixed at opposite end portions to said waist belt and attached to said chest belt and extending over a right shoulder of a patient, said belts and straps providing hand holds for use by a caregiver when assisting a patient; and a horizontal back strap positioned above said chest belt and extending between said left shoulder strap and said right shoulder strap.

11. A lift harness according to claim 10 wherein at least said waist belt and said chest belt are adjustable in length.

12. A lift harness according to claim 10 wherein said waist belt and said chest belt each has opposed end portions that are attachable and detachable from each other.

13. A lift harness according to claim 10 wherein said waist and chest belts are supported to an exterior surface of a base garment.

14. A lift harness according to claim 10 including a left shoulder lift strap secured at opposite end portions to said left shoulder strap and a right shoulder lift strap secured at opposite end portions to said right shoulder strap.

15. A lift harness according to claim 10 wherein said left and right shoulder straps are adjustable.

16. A lift harness according to claim 10 including a plurality of spaced apart double belt control straps interlinking said waist belt and said chest belt.

17. A lift harness adapted to fit on the upper torso of a patient and to be used by a caregiver to assist the patient in moving from one position to another or in standing or walking, comprising:

a horizontal waist belt that encircles a waist area of a patient;

a horizontal chest belt that encircles a chest area of a patient above said waist belt;

a left shoulder strap affixed at opposite end portions to said waist belt and attached to said chest belt and extending over a left shoulder portion of a patient;

a right shoulder strap affixed at opposite end portions to said waist belt and attached to said chest belt and extending over a right shoulder of a patient, said belts and straps providing hand holds for use by a caregiver when assisting a patient; and a plurality of spaced apart double belt control straps interlinking said waist belt and said chest belt.

* * * * *